US006889399B2

(12) United States Patent
Steiner et al.

(10) Patent No.: US 6,889,399 B2
(45) Date of Patent: May 10, 2005

(54) TEXTILE CLEANING PROCESSES AND APPARATUS

(75) Inventors: William K. Steiner, Aventure, FL (US); Michael Scott Steiner, Hallandale, FL (US)

(73) Assignee: Steiner-Atlantic Corp., Miami, FL (US)

( * ) Notice: Subject to any disclaimer, the term of this patent is extended or adjusted under 35 U.S.C. 154(b) by 44 days.

(21) Appl. No.: 10/333,675

(22) PCT Filed: Jul. 25, 2001

(86) PCT No.: PCT/US01/23444

§ 371 (c)(1),
(2), (4) Date: Jan. 22, 2003

(87) PCT Pub. No.: WO02/08510

PCT Pub. Date: Jan. 31, 2002

(65) Prior Publication Data

US 2003/0208853 A1 Nov. 13, 2003

Related U.S. Application Data

(60) Provisional application No. 60/220,663, filed on Jul. 25, 2000.

(51) Int. Cl.[7] ..... D06D 39/08

(52) U.S. Cl. ..... 8/159; 68/17 R; 68/19.2; 68/207; 68/13 R

(58) Field of Search ..... 8/149.1, 158, 148; 68/17 R, 13 R, 20, 19.2, 24, 58, 139, 207; 34/565, 566, 571, 586, 58

(56) References Cited

U.S. PATENT DOCUMENTS

| | | | | | |
|---|---|---|---|---|---|
| 2,389,433 | A | * | 11/1945 | Hough | 34/87 |
| 2,547,238 | A | * | 4/1951 | Tremblay | 34/603 |
| 2,927,379 | A | * | 3/1960 | Tann | 34/95 |
| 2,941,309 | A | * | 6/1960 | Cobb | 34/60 |
| 2,958,954 | A | * | 11/1960 | Longenecker | 34/527 |
| 3,022,580 | A | * | 2/1962 | Doty | 34/60 |
| 3,146,196 | A | * | 8/1964 | Bochan et al. | 210/380.2 |
| 3,261,185 | A | * | 7/1966 | Rihr | 68/213 |
| 3,364,585 | A | * | 1/1968 | Fish et al. | 34/527 |
| 3,583,180 | A | * | 6/1971 | Arbogast | 68/5 C |
| 4,207,683 | A | * | 6/1980 | Horton | 34/60 |
| 4,949,477 | A | * | 8/1990 | Geiger | 34/604 |
| 5,147,715 | A | * | 9/1992 | Thurman | 34/380 |
| 5,253,378 | A | | 10/1993 | Jung, Jr. | |
| 5,595,071 | A | | 1/1997 | Pasad et al. | |
| 5,641,742 | A | * | 6/1997 | Adamy et al. | 510/500 |
| 5,687,591 | A | * | 11/1997 | Siklosi et al. | 68/212 |
| 5,746,776 | A | * | 5/1998 | Smith et al. | 8/142 |
| 5,804,548 | A | * | 9/1998 | Davis | 510/439 |
| 5,863,299 | A | * | 1/1999 | Holt et al. | 8/142 |
| 5,891,197 | A | * | 4/1999 | Young et al. | 8/137 |
| 5,951,716 | A | * | 9/1999 | Lucia et al. | 8/142 |
| 6,024,767 | A | * | 2/2000 | Telesca et al. | 8/142 |
| 6,262,009 | B1 | * | 7/2001 | Rogers et al. | 510/439 |
| 6,381,870 | B1 | * | 5/2002 | Kohlman et al. | 34/311 |
| 6,684,440 | B1 | * | 2/2004 | Wise et al. | 8/158 |

FOREIGN PATENT DOCUMENTS

GB 1589911 * 9/1981

OTHER PUBLICATIONS

WO 96/09430 (Moser) Mar. 23, 1996.*
WO 97/00993 (Reckitt) Jan. 9, 1997.*

* cited by examiner

*Primary Examiner*—Frankie L. Stinson
(74) *Attorney, Agent, or Firm*—Robert M. Schwartz; Gerald Hibnick; Ruden McClosky Smith Schuster & Russell, P.A.

(57) ABSTRACT

Processes and apparatuses for commercial and home-use cleaning of textile. Home-use embodiments replace the home laundry clothes dryer, except for embodiments using a novel manual kit. Home-use embodiments have an integrated spotting station. Soiled/stained textile is spray dampened with solvent, preferably automatically in the apparatus' rotatable drum; but the textile is not soaked nor immersed in solvent. Highly absorbent, untreated pad material is placed into the drum, for rubbing against the tumbling textile, to remove the soil, stains and solvent.

38 Claims, 3 Drawing Sheets

10

50
36
16
38
60
62
35
52
58
54
26
38
33
26
41
44
34
28
24
22
45
40
42
32
30
39
48
20
18

Fig. 3
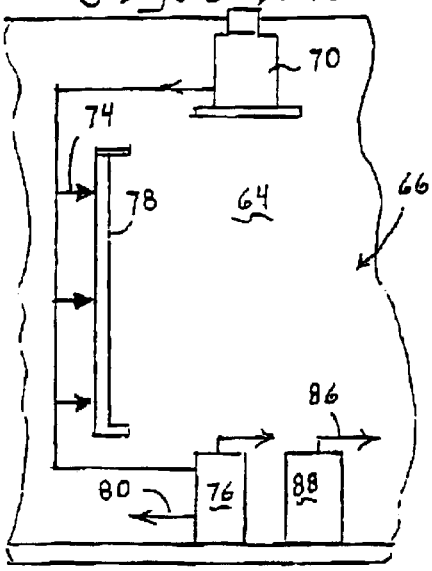
Fig. 5
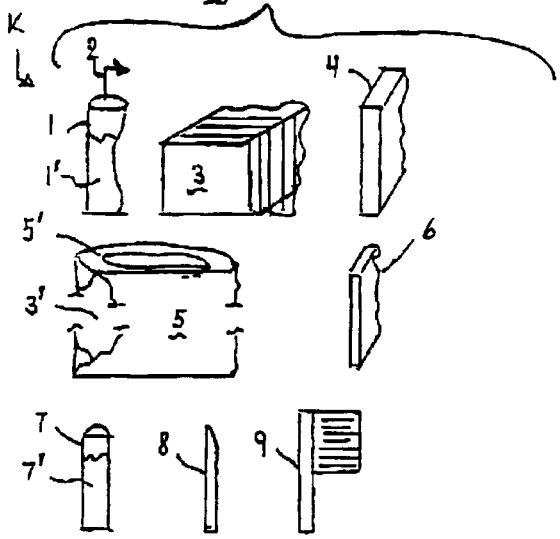
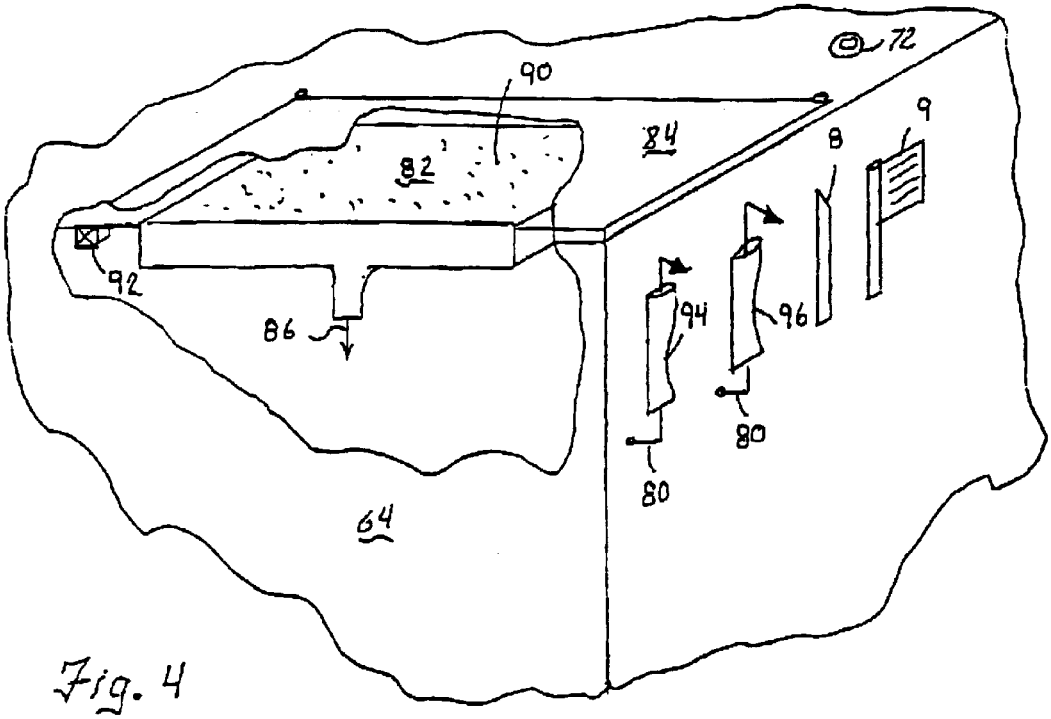
Fig. 4

TEXTILE CLEANING PROCESSES AND APPARATUS

CROSS-REFERENCE TO RELATED APPLICATION

This application claims the benefit of U.S. Provisional Application Ser. No. 60/220,663, filed on Jul. 25, 2000, entitled DRY CLEANING PROCESSES AND APPARATUS.

BACKGROUND OF THE INVENTION

1. Field of the Invention

This invention concerns textile cleaning processes and apparatuses, useful in commercial facilities, group housing and private dwellings.

2. Prior Art

Dry cleaning processes and apparatus have been in use commercially for a considerable length of years. For the most part, commercial processes have changed/improved relatively little except for the use of less dangerous solvents. Likewise, commercial dry cleaning equipment, except for more automation, is mostly the same for the past fifty years and do that which was done previously.

Commercial dry cleaning, as is well known, is not a dry process, it is basically a waterless process, using liquid solvents, in which the soiled textiles are immersed and mixed in a rotating drum until the soil transfers from the textile into the solvent bath. An historic problem in the commercial dry cleaning equipment and process was the use of solvents which were dangerous to handle and inhale, had low flash points; and when disposed, both as liquid and vented to the atmosphere, were environmentally hazardous/unfriendly. In at least countries where health and environmental regulations are enforced, those historic problems of the solvents have been eliminated or greatly diminished by user and environment friendly solvents. However, the volume of solvent needed to immerse the textiles in the drum presents its own problems: cost, storage space, proper disposal, filtering and recycling, etc.

Quite recently, there has entered the market place kits for home-use, in home clothes dryers, for freshening and cleaning of garments which cannot be washed in water and are not so soiled that commercial dry cleaning should be used. Although such kits are convenient to use, their capability to satisfactorily remove soil is limited. Such kits have solvent impregnated, small, thin sheets which are put into the dryer drum with the soiled garments. The heat within the rotating drum releases the solvent from those sheets into the atmosphere of the drum. The tumbling garments are "immersed" in the solvent containing atmosphere for the cleaning function. The sheets also are impregnated with a pleasant fragrance substance, to impart a clean smell to the garment. Some kits also include pre-spotting solution, to be applied to selected soil spots of the garment, prior to being placed into the dryer drum. A problem with the use of such kits is that either extensive pre-spotting is needed, or the cleaning is inadequate, or both. Some kits also include a bag into which the garments and impregnated sheets are placed. The bag inhibits the garments from contact with the hot interior surface of the drum and also confines the solvent containing atmosphere.

SUMMARY OF THE INVENTION

The novel features of this invention overcome prior art dry cleaning problems, provide a more efficient commercial and home-use textile cleaning apparatuses and processes and also provide a more effective home-use textile cleaning process suitable for a kit. An important "component" of the invention, for both the commercial/professional embodiment and the home-use embodiments, is the employment of highly absorbent, untreated pads, which are placed in the dryer drum, for the purpose of rubbing against the textiles, so as to remove soil and absorb cleaning solvent which is sprayed on the textiles.

In the commercial and automated home-use embodiments, the textiles are not immersed in solvent. A sufficient, small amount of solvent is sprayed, onto the textiles when inside the drum, early in the cleaning process. Thereupon, rotation of the drum brings the textiles and pads into frictional contact, repeatedly. The pads can be removably fastened to the "lifting" ribs and body of the drum and/or be free to move about in the rotating drum. For this home-use embodiment, if there are no ribs to secure the highly absorbent, untreated pads, the pads are placed loosely in the drum.

In a manual home-use embodiment, the textiles are sprayed, not soaked nor immersed, with the cleaning solvent, prior to being placed into the drum.

A highly effective, home-use process and unit includes a soil spotting station, which is integrated with the solvent spraying and absorbing pads in the drum. If purchase costs and consumer demand required, three hybrids of the home-use unit and process could be provided: (1) Having both in the drum spraying of the textile and a spotting station; (2) omitting in the drum spraying, and replacing it with the manual kit K, but retaining the automated spotting station; (3) retaining the in-drum spraying and the in-drum pads, but omitting the spotting station.

As employed herein, the term "textile" is used generically to encompass garments, fabrics, cloth, and all other materials which typically are dry cleaned, rather than washed in water. The term "solvent" also will be used generically to encompass dry cleaning solutions as known historically, recently formulated, water based, and formulated in the future for the intended purpose. "Drum" encompasses the old types of dry clean wheels as well as present and future drum-type commercial (professional) apparatus which rotates around at least one axis, holds the soiled textiles and historically also the immersing solvent. "Drum" also includes the rotating part of commercial dry cleaning machines and domestic clothes dryers. "Pad" is a generic term, unless specifically limited, and encompasses a wide variety of materials, shapes and sizes, but is not to be confused with the thin, small solvent/freshener impregnated sheets used in the prior art home-use kit K.

"Untreated" is a limiting term to the pad and means that the pad does not contain/not impregnated with cleaning solvent, as it taught in the prior art.

Other features of the improved process and apparatus will be disclosed in the next following detailed description.

BRIEF DESCRIPTION OF THE FIGURES

FIG. 3 is a partial side view of a home-use unit, with its side cover removed;

FIG. 4 is a partial top view of a home-use unit, somewhat pictorial and broken away to show the spotting station; and FIG. 5 is a pictorial illustration of the contents of a home-use starter kit, with components not to scale with respect to each other.

DETAILED DESCRIPTION OF THE PREFERRED EMBODIMENTS

Figure 1:
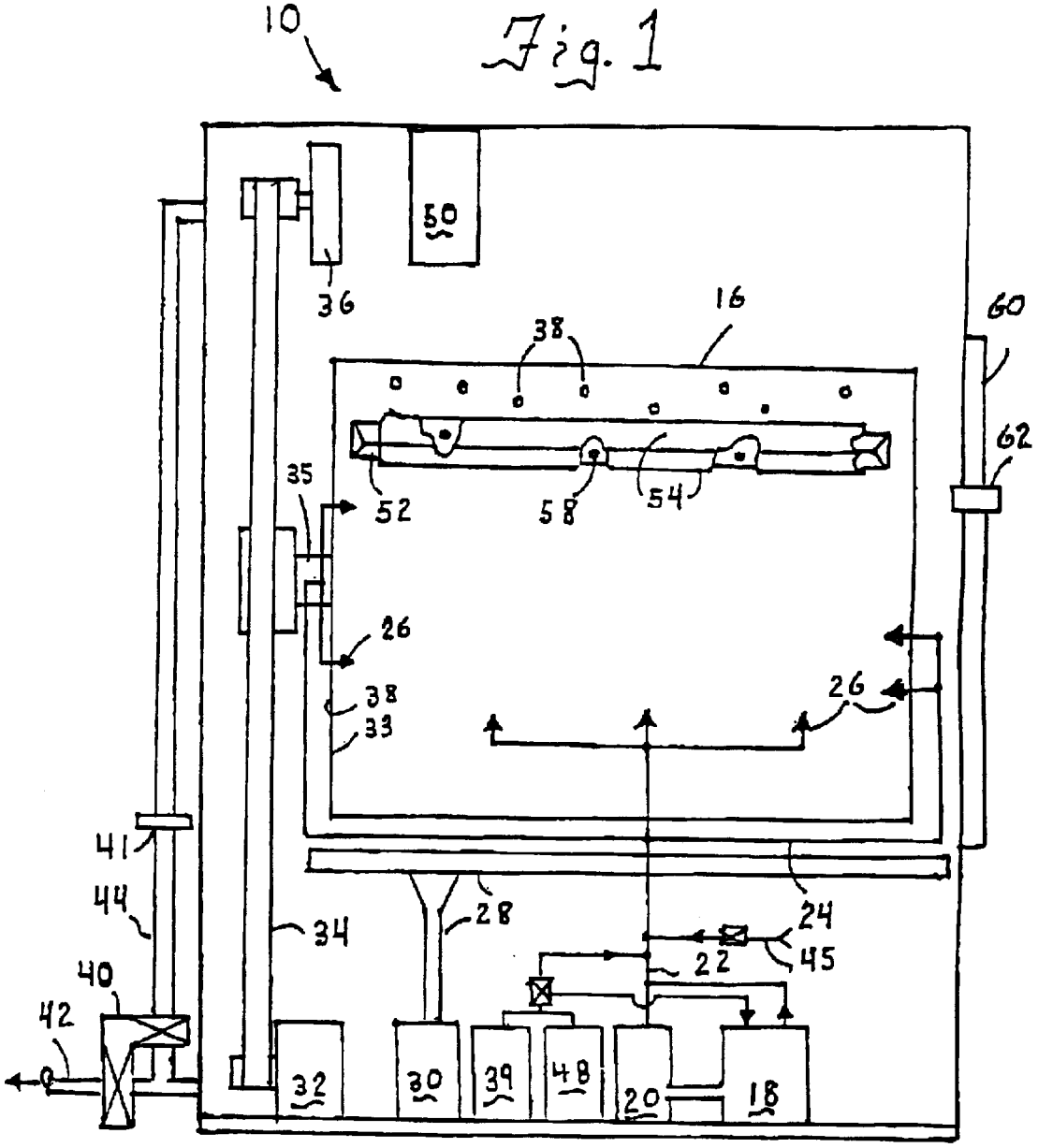
FIG. 1 is side view of the commercial cleaning machine of the invention, with its side cover removed and somewhat pictorial, showing major component parts.

Described first will be the home-use, suitable for a kit sold in grocery stores, embodiment. As shown in FIG. 5, the contents/components of a starter kit K would be: a bottle 1 of solvent 1', preferably with a spray dispensing head 2; a plurality of highly absorbent, untreated pads 3, and instructions 4 for their use in a standard, home style, clothes dryer. Optionally, the kit K also could include a one-use or repeat-use containment bag 5 for holding the textiles and pads in the drum of the dryer, one purpose of which is to keep the textiles hydrated with the solvent for a sufficient time. Another optional component, especially useful if a containment bag is not used, is covering means 6, positionable over the typical lint filter of the home style dryer, to reduce air flow from the dryer drum, thereby to keep the textiles hydrated with the solvent for a sufficient length of time; so that their frictional contact with the pads is such that the pads are rubbing over the damp textile, to rub off the soil and absorb the solvent. Also optional, but preferred, is a container 7 of spot removing liquid 7' having an applicator tip and a spotter bone 8 and brush 9; to be used before and/or after cleaning by the process of this invention, as might be needed for stubborn/unique spots of soil.

The pads 3 for this home-use unit embodiment can be of a wide range of shapes, sizes and materials; and, for that reason, are not shown in detail in any Figure of this specification. These pads should have enough mass to frictionally confront and rub against the textile. A thickness of about one-quarter to one-half inch (about 0.60 to 1.25 cm.) has worked well with surface areas of ten to fifty square inches (about 65 to 325 cm. sq.). The quantity of pads depend upon their sizes, the amount of textile material to be cleaned, the volume of the drum, the duration of drum rotation, the rate of solvent evaporation and extent to which the textile is soiled. Additional variables are the material of the textile and its thickness. Also, some solvents can function better at different temperatures than others, which can affect their evaporation rate. The quantity and weight of the textiles being cleaned and the amount of the pads should be such that the random tumbling movement of the pads and the textiles in the rotating drum causes a considerable amount of surface-to-surface rubbing contact therebetween, which is essential for adequate cleaning by this process. The material of the pads is to be highly absorbent, smooth texture and not the source of and undesirable amount of lint from its own body or because of its rubbing against the textile. Cotton, felt, terry, etc. are materials of the type which provide the absorbence, smoothness and weight desirable for a pad to be used in both this home-use and the commercial embodiments of this invention. Preferably, the pads can used for a few loads of cleaning, before they are too dirty to be used again. Then, they can be cleaned/washed for further use.

The solvent 1' and the optional pre-spotting liquid 7' can be selected from any of many existing, as well as future formulated, user friendly and environmentally approved liquids, including water-based cleaners and water diluted mixtures thereof. A few examples of such solvents are:

DF-2000, a synthetic aliphatic hydrocarbon manufactured by Exxon Chemical Co., Houston, Tex.; Vista LPA-142, a paraffinic, maphthenic, manufactured by Vista Chemical Co., Houston, Tex.; N-Ta Germ Liquid, an alkyl dimethyl benzyl amonium chloride; N Ta Germ Wet Clean additive: DWX-44 detergent, DWX-Spray Spotter, Kleerospray Spotter, Nature-L additive, each manufactured by Kleerwite Chemical, Burke, Va.; Cal-Off, a pre-spotter, diethylene glycol methyl ether, manufactured by Caled Chemical, Wayne, N.J.; and Zuds, a water based spotting compound, also manufactured by Caled Chemical.

Experience to date indicates that the solvent can contain at least 75% water and the spotter should be more concentrated. As is known, a spotting solution can be used before and/or after the textile is cleaned in the drum.

The optional containment bag would have sufficient volume to hold a few garments/textiles and the above identified pads 3, such that the textiles and pads can tumble freely within the closed bag as the drum rotates. The bag would have some form of closure 5' and be of a material which can withstand repeated use. It can have one or more layers, one of which would be somewhat vapor impermeable, to reduce the rate of evaporation of the cleaning solvent; whereby, the solvent can be of maximum use in working on/in the textile, for removal of the soil and the used solvent onto the pads. In a preferred embodiment of the containment bag 5, it would have an inner layer or liner 3' of the pad material, to enhance the rubbing off of the soil from the textiles. Having some or all of an inner layer 3' of the highly absorbent, untreated pad material can reduce the amount of the pad pieces 3 otherwise placed into the containment bag, or the drum, if there is no bag. Under some conditions of textile material and soil content, it would be sufficient for the pad inner layer to obviate need for the individual pieces of pad. Hence, the term "pad" for the home-use unit, encompasses the three conditions of: (a) only loose pieces of pad 3; (b) only an inner layer or liner of pad 3'; and (c) both (a) and (b).

As noted above, it is important to keep the textiles hydrated with the solvent 1' for a sufficient duration, without immersing or soaking or even wetting down the textiles prior to placing them directly into the drum, or into the containment bag which then goes into the drum. Preferably, the textiles are only mist-sprayed with the solvent. Accordingly, especially when a containment bag is not employed, the home-style dryer should be inhibited from the extent/rapidity of its normal venting, by reducing the amount of air flow into and out from the drum. Typically, the primary amount of venting air passes through the lint filter. Hence, blocking of the lint filter will reduce the solvent evaporation rate. Such blocking can be partial or total and can be accomplished in various ways by various means; one simple means would be the insertion of a piece of fabric 6 into and covering the lint filter.

There is to be no concern over attaining too much heat in the rotating drum or at the lint filter, since the dryer is to be operated without use of heat, such as in the "air fluff" mode. The temperature range within the drum would be home interior ambient, 60° to 95° F., (about 15° to 35° C.). Possibly, a small amount of heat could be used if the dryer was in a cold location, or if a specific solvent worked optimally at warm, not hot, temperature.

The duration of textile tumbling in the dryer drum with the highly absorbent, untreated pads, will depend upon the size of the drum, the size of the load, the amount of pads and the textile material. About 20–30 minutes usually will be needed. It is to be appreciated that the cleaning process according to this invention does not require that the textile be dry before removal from the dryer. To the contrary, if the textile is too dry, it could wrinkle. Preferably, the textile is removed from the dryer drum and containment bag if such bag is used while the textile is slightly damp. Then, the textile is placed on a hanger or the like to dry without wrinkling.

If the textile should be pre-spotted with the spotter 7' prior to mist spray with the solvent 1', or post-spotted after removal from the dryer, depends upon individual circumstance. As is well known, some specific spots are more easily removed by certain spotting solutions. Hence, the kit K form of this invention can contain more than one spotting solution; or different spotting solutions can be packaged separately from the starter kit K. Also, there can be "refill" kits containing the primary solvent, with or without additional pads, with or without additional containment bags.

Although most of the soil removed from the textile will be deposited onto the pads by virtue of rubbing thereagainst, some of the soil will be released directly from the solvent treated textile into the atmosphere of the drum; and some of the soil might come away from the pads and also be released into the drum atmosphere. To avoid redeposition of the atmosphere entrained soil particulates onto the textile, there needs to be a sufficient air flow out from the rotating drum, primarily via the lint trap/vent. Such need for venting air flow is in opposition to the need to retard solvent evaporation by at least partially blocking the lint trap as with the cover 6, as above discussed. A balance between these two needs should be accomplished to optimize the cleaning process and can be termed "regulated air flow". If a containment bag is employed, the "regulated air flow" function can be accomplished by the amount of vapor impermeability of the bag by itself, or in combination with partially blocking the lint trap.

In as much as cleaning by the home style dryer process and kit K/components of this invention is more complete than in the prior art, freshness scent does not have to be used; however, some users might prefer an added freshness, which could be provided via an optional scent impregnated and releasing sheet to be put into the dryer. If the need for freshness scent was dominant, the scent could be incorporated into the solvent or the pads or the containment bag. However, the presence of such freshness scent in/on the pads does not alter the fact that they are highly absorbent and untreated with respect to the cleaning solvent.

From the above description of the kit K for the home-use, the process with its required and optional steps should be understood to be as follows:

1. (Optional) Examine textile to decide if pre-spotting is needed.
2. (Optional) Pre-spot with the spotter 7', bone 8 and brush 9.
3. Mist spray entire textile with cleaning solvent 1'.

4a. Place soiled textile and untreated rubbing pads 3 into the drum of the dryer; or 4b. Place the textile and the pads into a containment bag 5 and put the bag into the drum; or 4c. Place the textile into a containment bag 5 having therein pads 3' and put the bag into the drum.

5. Regulate air flow through the drum; which can be by use of the containment bag 5 and/or the lint trap cover 6.
6. Employ a drum temperature of home interior abient.
7. Rotate the drum for a time sufficient for the textiles and pads to rub against each other to transfer soil from the textile to the pads and for some of the solvent to be absorbed by the pads.
8. Remove textile from drum prior to the formation of wrinkles, usually when slightly damp.
9. Hang the garments for wrinkle free drying.
10. (optional) Post-spot the textile.
11. Remove pads from dryer and/or containment bag.
12. (Optional) Examine the pads and/or containment bag to verify that they are sufficiently clean for subsequent use; and cleanse them if not sufficiently clean.

The process of the commercial/professional embodiment of this invention is very similar to the home-use embodiment, except it takes advantage of being able to use some existing commercial dry cleaning technology and improve upon it. Primarily, the novel features of the commercial embodiment are: (1) The solvent mist spraying and air/water/steam jetting upon the textile are automatically accomplished in the drum, while the drum is rotating and during rotation dwell times. (It is to be emphasized that the textile is not immersed in a solvent or water bath, nor soaked in the solvent or water.) (2) The untreated, highly absorbent pads are secured to the lifting ribs of the drum. (3) Regulation of air flow, drum temperature, drum r.p.m., solvent spraying, and moisture level are accomplished by sensors and computer controls.

Figure 2:
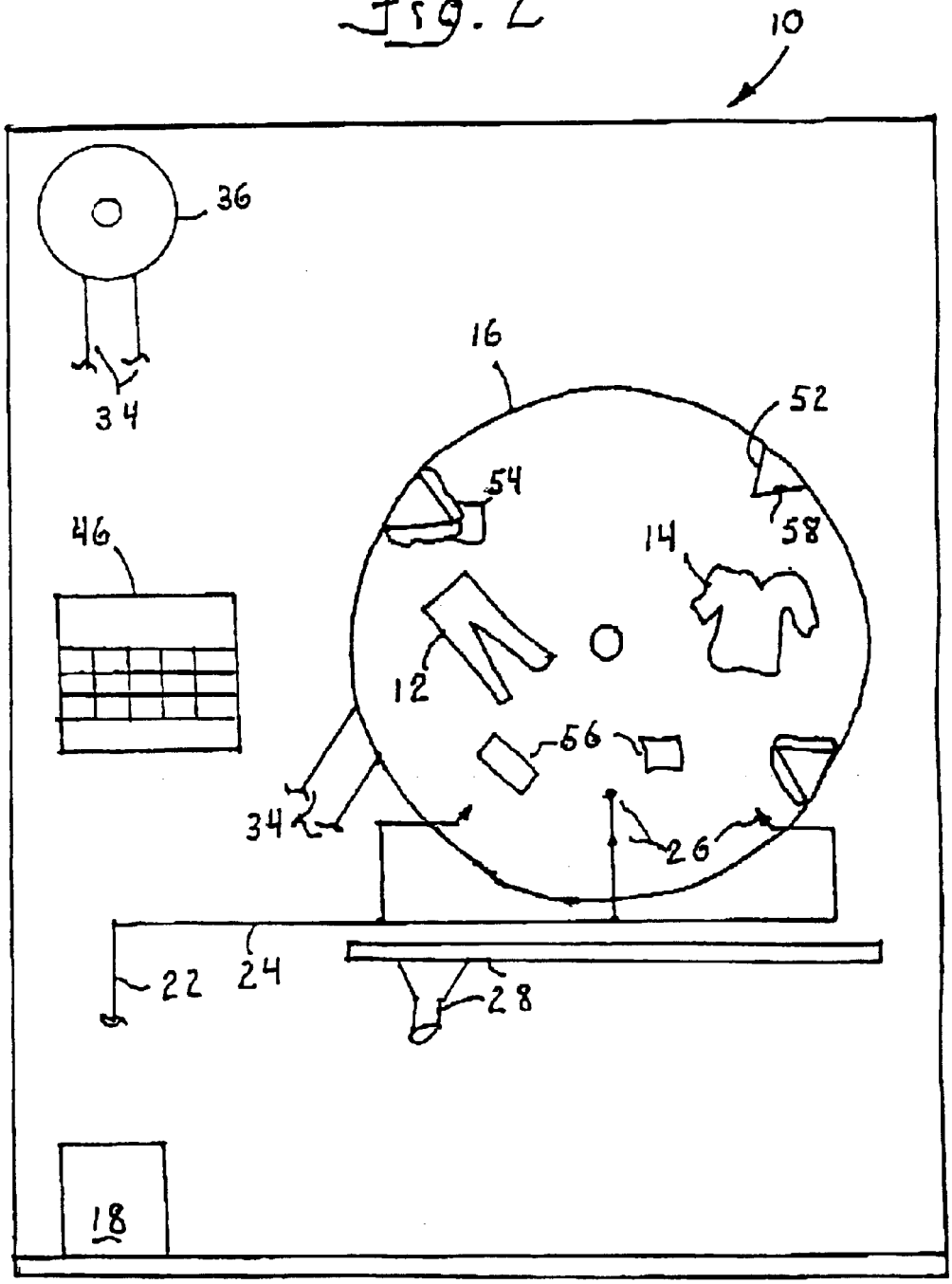
FIG. 2 is a front view of the cleaning machine of FIG. 1, with its front cover off, somewhat pictoral, showing major component parts, with pads and textile in the drum.

More specifically and with reference to FIGS. 1 and 2, the commercial textile cleaning machine 10 can be an existing piece of equipment, modified to employ the novel process of this invention. However, a new, simpler, textile cleaning machine 10 can be built to perform the new method.

With reference to FIGS. 1 and 2, which show somewhat pictorally the side and front views of a commercial dry cleaning machine 10, with cover panels removed, embodying the invention, but showing only major components; it will become evident to those skilled in the art that the machine 10 is simpler than an existing commercial dry cleaning machine, can be less rugged, more economic and simpler to use. Since the process employing the machine 10 does not immerse the textile 12, 14 in a solvent bath, nor even soak that textile in solvent, there is no need for placing many gallons of solvent into the drum 16; thus avoiding having hundreds of pounds of solvent supported in the revolving drum. There is not any expensive and bulky solvent recovery and recirculation system, since less than one quart (one liter) of solvent is needed by the invention per twenty-five pound (11 kilograms) load and mostly is absorbed by the untreated pads and/or are vented out with the soil particulates. Hence, the solvent container 18 can be housed easily within the machine 10 and connected to a pump 20, which will pump the solvent into the drum 16 as a spray mist, via lines 22, 24 and jet heads 26. The solvent tank 18 can represent a plurality of tanks coupled in parallel and holding different: solvents, conditioners, sizing, water proofing, fire proofing, etc. substances. The pump 20 can generate 60 to 110 p.s.i. Alternately (not shown), a barrel or large tank of the solvent can be located outside of the machine 10 and connected to the pump 20. Since the pump is moving a small quantity of solvent, it can be smaller then presently needed in commercial dry cleaning equipment. If there results a small volume dirty waste liquid, it can be collected from the drum by waste disposal means 28, 30 and then removed according to regulatory/environmental procedures, which could be as simple as flushing down to a sewer; which is especially a viable form of waste disposal, since a preferred embodiment of the solvent can be water-based.

Since the drum 16 is not to contain a heavy volume of solvent, it can be a lighter structure, have lighter support and be rotated by a smaller motor 32, coupled to the rear 33 of the drum via a belt 34, driven shaft 35, etc. than present dry cleaning machines. The motor 32 also can be used to drive the air circulation fan 36, but separate motors (not shown) could be more practical. The interior periphery of the drum 16 is perforated 38, as is typical, so that not only the air circulated by the fan 36 can enter the drum, but especially the jet mist spray of solvent 18, can enter via the jet heads 26, which are positioned next to the drum. The jet heads 26 also can supply air only, or pressurized water from an interior supply 39 or an exterior supply, or a mixture of air and water. The jet heads 26 are position to direct solvent, etc. along the axial direction of the drum and at right angles thereto, so as to dampen the textiles from plural directions. Since the rear end 33 of the drum 16 is closed, except for the perforations 38, the jet heads 26, pointing into the drum's rear end, would be journaled (not shown) for rotation with the drum. For ease of viewing the FIGS., the perforations 38 are not shown in FIG. 2 and only a few are shown in FIG. 1.

For the same reason as discussed for the home-use embodiment, the commercial embodiment requires the textile 12, 14, to remain damp with solvent; hence, solvent evaporation rate needs to be retarded/controlled. Such control is provided by a damper 40, which is located in an air output line 42 and an air recirculation line 44 that returns air from the drum to the input side of the fan 36, for reintroduction into the drum, via the perforations 38. If the damper 40 is closed, the recirculating air, which also carries solvent moisture, is passed through a lint and dirt filter 41 and returned to the drum to help in continuing the hydration of the textiles. If the damper is open, the moist air can pass outward through the output line 42. If needed, to increase the hydration, moist air and/or steam can be supplied through the jet heads 26 from a line 45, which is connected to a source (not shown), such as a small external boiler. Such steam/moisture also can be supplied at selected times to: clean water soluble stains; reactivate solvent on the drying textiles; and give a final "hand" to the textiles. Also, the fan 36 can be turned off as well as have its speed changed, via a program panel 46. The program panel 46 is connected to preset the sequential operations of the machine 10 into various modes, as well as enable random inputs by an operator. Opening and closing of the damper 40 is one of the many operations via the program panel 46.

The machine 10 also includes an air compressor 48, which can be part of or separate from the pump 20, but can be used in conjunction therewith. The compressor can be used to provide the jet action for the jet mist solvent spray through the line 22, 24 and jet heads 26. Also, the compressor 48 can supply jets of air, without accompanying solvent, through the jet heads 26, for purposes discussed further below, and for propelling steam/moisture from line 45.

A heater 50 is provided to warm the circulating air. The program panel 46 controls when the heater is on and what temperature is to be provided. Programming also controls various valves, only a few of which are illustrated in FIG. 1. The term "program panel" is used herein to represent all needed programming means, sensors, etc., etc., since such programming means and operations are well within the skill in the art.

Typically, drums of dry cleaning machines contain a plurality of textile lifting ribs 52 which cause the textiles to be lifted away from the periphery of the rotating drum and tossed toward its axis of rotation. Such ribs 52 play an important additional roll in the present invention. The highly absorbent, untreated pads 52 are removably mounted along these ribs. For ease of viewing FIGS. 1 and 2, only a few of the ribs 52 are shown, and only three of the ribs, one in FIG. 1 and a different two in FIG. 2 have pads 54 mounted thereon. In actual practice, both sides of each rib 52 can support pads 54. If there are four ribs 52 in a drum and they project radially inward five inches and are thirty six inches long (about 13 cm. high and 90 cm. long), they can support approximately one thousand, four hundred and forty square inches of pad, which is ten square foot of surface (approximately 9,360 cm. sq.). The rotation of the drum 16, for twenty to thirty minutes, with this pad surface, will result in a significant amount of soil removing, rubbing contact between the textiles 12, 14 and the pads 54. If conditions require more pad surface, the drums can be built with more ribs; also, loose pads 56, as employed in the home-use embodiment, can be put into the drum 16. Typically, the ribs 52 are perforated, or can be perforated as at 58. The pads 54 can be provided with clips (not shown) for detachably mounting the pads onto the ribs. Other mounting means, such as velcro or adhesives can be used, so that the pads can be removed for periodic washing and/or replacement.

The access door 60 into the drum 16 is provided with a safety latch 62, which inhibits all machine operations if the latch is open. However, this safety feature can be overrode by a special command from the control panel 46. The motor 32 normally is preprogrammed to reverse the direction of the drum rotation a few times each minute, with a dwell time of a few seconds, to increase the tumbling action of the textiles and their soil removing rubbing against the pads 54. The speed of the motor 32 is moderate —20 to 50 r.p.m.—but could be programmed with other speeds. The jet heads 26 nearest to the access door 60 can be mounted through that door. Thus, when that door is open, the jet heads and associated fluid lines, such as the line 24, will not interfere with easy entry and removal of the textiles.

The process for using the new textile cleaning machine 10, or an old commercial dry cleaning machine modified to have the basic new components needed to carry out the process of this invention would be:

1. (Optional) determine if the textiles 12, 14, need to be pre-spotted.
2. (Optional) Pre-spot the textiles before placing them into the drum 16.
3. Ascertain that the machine 10 has been provided with suitable solvent 18 and pads 54.
4. Program the machine operations via the panel 46 and/or select one of the existing programs.
5. Place the textiles 12, 14 into the drum 16 and close the door 60 to enable the safety latch 62.
6. Start the programmed operation of the machine from the panel 46, such program having steps of:
7. Engaging the motor 32, the fan 36 and the compressor 48 for a period of time, such as five minutes, to blow jets of air through jet heads 26 to loosen from the tumbling textiles, dirt and lint, for their removal past the damper 40, which has opened the output line 42.
8. (Optional) Supply pressurized steam, via the line 45, through the jet heads 26, to remove water soluble stains from the textiles 12, 14.
9. Close the output line 42 via damper 40, pump solvent 18 through the misting jet heads 26 for a period of time of one to five minutes, depending in part upon the material of the textiles, the size of the load, the extent and nature of their soil. The amount of solvent is to dampen, but not soak the textiles. Since the textiles are not to be immersed in solvent, as in conventional commercial dry cleaning, nor be soaked with solvent; but only have solvent mist jet sprayed thereon to dampen or wet the textiles, the process of this invention could be identified by the term "Dry-Wetcleaning™".
10. Regulate the temperature in the drum and the hydration/evaporation rate of the textiles by the heater 50 and/or the fan 36 and by opening and closing the recirculation line 44 via the damper 40; as well as by injecting moisture, via the line 45, through the jet heads 26. Such regulation can start with step 9 or later in step 11.

11. Continue the tumbling/rotating/cleaning for ten to twenty-five minutes after the injection of the solvent has stopped, but do not continue if the textiles are becoming too dry, which can cause wrinkling to occur.
12. Open the output line 42 and close the recirculation line 44, via the damper 40 for a few minutes to enable particulate soil, solvent aerosol and lint to be blown out the output line 42, and to aerate the textiles.
13. The programmed process has been completed, the safety latch 62 is released by the program and the door 60 can be opened to remove the cleaned textiles, which can be slightly damp, but suitable to go to the presser and/or placed on hangers.
14. (Optional, but desired) Examine the textile for need to post-spot and/or re-do the cleaning of the textile with the same or a different program.

A significant improvement in a home-use textile cleaning process and unit 64 next will be described with reference to FIGS. 3 and 4. This unit and process employ both the mist spraying of solvent air and water into the drum and the highly absorbent pads of the commercial embodiment of FIGS. 1 and 2; hence, it does not use the textile containment bag 5, nor the manual pre-spraying of the solvent onto the textiles, as described hereinabove with reference to FIG. 5 and the home-use kit K. This home-use unit 64 basically starts from a typical home-use clthes/laundry dryer, with its horizontal axis rotatable drum, heater, filter, etc.; hence, these components are not shown in FIGS. 3 and 4. Also not shown is the typical front loading access door and electric controls. It is to be understood that this new unit 64 also continues to be usable as a typical home-use laundry room clothes dryer.

FIG. 3 shows the right side 66, near its rear, with its side panel 68 removed, of the home-use unit 64. A refillable supply of Dry-Wetcleaning™ solvent is supported in a container 70 in the interior of the unit 64 and has its capped refill opening 72 projecting out from the top of the unit. A plurality of spray heads 74 are coupled to both the solvent container 70 and a compressor 76, so as to be able to spray solvent through perforations (not shown) in the typically non-rotating end cover 78 of the rotatable drum (not shown); whereby, textiles in the drum can be dampened by the solvent, similar to the jet spray solvent dampening in the commercial embodiment of FIGS. 1 and 2. The compressor 76 also feeds air pressure to portions of the spotting station, via one or more lines 80.

If the interior of the drum has lifting ribs, such as the ribs 52 shown in FIG. 2, or the interior of the drum is adapted to have pads 54 secured thereto, then the solvent spray dampening and the textile cleaning by rubbing against the absorbing pads 54 will be accomplished in much the same manner as in the commercial embodiment disclosed with reference to FIGS. 1 and 2; exceptions being that in that embodiment there is more automation and the drum 16 can rotate in opposite directions, between which there can be programmed dwell time used for additional spraying of the solvent, etc. If the pads 54 are not secured to the interior of the drum, or such pads do not provide sufficient rubbing and absorbent surface, loose pads 56 would be placed in the drum.

A spotting board 82 is mounted inside the top of the unit 64 and is just below a hinged cover 84, as shown in FIG. 4. The spotting board is coupled by a line 86 to a source of vacuum 88. As is well known in commercial dry cleaning facilities, the spotting board is a hollow chamber having a top surface 90 which is perforated. When the vacuum source 88 pulls a vacuum, evaporating solvent, aerosols and small perticulates, such as from a soiled textile (not shown) lying on the spotting board surface 90, will be drawn from the textile through the perforate surface 90, and out to waste. The vacuum source 88 can be turned on and off via a small switch 92, that responds to the opening and closing of the hinged cover 84. The vacuum source 88 preferably can be the exhaust fan. Removing stains, spots etc. would be accomplished as at commercial dry cleaning facilities, by use of hand held sprayers 94 and 96 respectively containing solvent and water. It would be desirable if at least one of sprayers also could jet a stream of air, without any liquid. The sprayers would be refillable manually and have finger tip control over the amount of fluid being dispensed onto a textile lying on the surface 90 of the spotting board 82. A spotting bone 8 and brush 9 can be mounted conveniently to the right side panel 68, as also could be mounted the sprayers 94 and 96.

Thus, a conventional domestic clothes dryer can be replaced by the home-use unit 64, having all the functions of the domestic clothes dryer, most of the Dry-Wetcleaning capabilities of a commercial machine 10 according to the embodiment of FIGS. 1 and 2 and additionally have an integrated spotting station, a feature not found in commercial dry cleaners.

It also is possible to define a third, less expensive, embodiment of the home-use process and unit, a hybrid of the first two. Such hybrid would contain the vacuum operated spotting station, the drum mounted and/or loose pads and the manual kit, but would omit the automated, inside the drum, solvent spraying and the compressor powered sprayers. The sprayers 94, 96 would be manual.

If automated, in the drum, solvent spraying of FIG. 3, with secured and/or loose pads, was considered more desired than the spotting station of FIG. 4, a different hybrid process and apparatus could be created by elimination of the spotting station, keeping the spraying components of FIG. 3, and also omitting the kit K of FIG. 5.

The hereinabove description of the commercial/professional and home-use processes and the embodiments of textile cleaning machine 10 and home-use unit 64 should enable those skilled in the art to construct new textile cleaning machines, or make modifications to an existing dry cleaning machine, or home-use clothes dryed while remaining within the scope of the inventions. The same applies to the first described home-use process and the components kit K for use therewith.

That which we claim is:

1. Apparatus for cleaning textile in a drum rotatable within a machine, said apparatus including:

spraying and dampening means for spraying liquid onto the textile, other than for spotting, to dampen the textile, in the absence of soaking or immersing the textile in any liquid; and highly absorbent pad material in said drum;

said pad material and the dampened textile being in rubbing contact as said drum rotates; whereby, soil and liquid are transferred from the textile to said pad material.

2. Apparatus according to claim 1 wherein, at least some of said pad material is detachably secured within said drum.

3. Apparatus according to claim 2 wherein, said drum has interior lifting ribs; and said pad material is detachably secured to said lifting ribs.

4. Apparatus according to claim 1 wherein, said pad material is untreated.

5. Apparatus according to claim 1 wherein, said pad material is felt.

6. Apparatus according to claim 1 in which, said pad material, after having liquid transferred to it, becomes a source for providing hydration to the interior of said drum and the textile therein.

7. Apparatus according to clam 1 in which, said pad material is in the interior of a textile containment bag.

8. Apparatus according to claim 7 in which, said containment bag and said spraying and dampening means are part of a kit.

9. Apparatus according to claim 1 in which, said spraying and dampening means is constructed and arranged to spray liquid automatically into said drum from exterior said drum.

10. Apparatus according to claim 9 in which, said spraying and dampening means includes automatic spraying equipment, for spraying into said drum at least one of said solvent, air, steam or water, without soaking or immersing the textile in said drum.

11. Apparatus according to claim 9 in which, said drum is rotatable bidirectionally; and said spraying and dampening means is positioned and controlled to operate distinctively, depending upon the direction of drum rotation.

12. Apparatus according to claim 1 in which, said rotatable drum is controlled to have a dwell time; and said spraying and dampening means is controlled to operate distinctively during said dwell time.

13. Apparatus according to claim 1 in which, said spraying and dampening means is constructed for manual use, exterior to said machine.

14. Apparatus according to claim 13 in which, said pad material and said spraying and dampening means are part of a manual use kit.

15. Apparatus according to claim 1 in which, a spotting board is vacuum coupled to said machine; and said machine is a home-use clothes dryer.

16. Apparatus according to claim 1 which, said drum has:

means for venting air flow out therefrom; and venting regulating means, positionable to control the amount of venting air flow and thereby control the hydration of said pad material.

17. A textile cleaning kit for manual use in the cleaning of textile in a home-use clothes dryer having a rotatable drum; said kit including:

spraying means for spraying cleaning liquid onto the textile, only to dampen the textile, and other than for spotting, prior to the textile being placed into the drum; and highly absorbent pad material to be place into the drum; whereby, rotation of the drum causes rubbing contact between said pad material and the dampened textile, for transfer of soil and liquid from the textile to said pad material.

18. A kit according to claim 17, also including:

control means for controlling the venting of air flow from the drum, so as to extend the duration of hydration of the dampened textile.

19. A kit according to claim 18, wherein said clothes dryer includes a lint filter for venting air from the drum; and said control means comprises structure for at least partially blocking the lint filter.

20. A kit according to claim 17, in which said pad material is in the interior of a textile containment bag.

21. In a process for cleaning textile in a rotatable drum of a machine, the steps of:

dampening the textile with liquid other than for spotting, in the absence of soaking or immersing the textile in any liquid;

placing highly absorbent pad material into the drum;

rotating the drum, thereby;

causing the textile and pad material to tumble against each other, to effect;

rubbing transfer of the liquid and soil from the textile to the pad material.

22. In a process according to claim 21, said placing being by;

securing detachably the pad material into tho drum.

23. In a process according to claim 21, employing felt as the pad material.

24. In a process according to claim 21, utilizing the pad material as a source of hydration for the textile in the drum.

25. In a process according to claim 21, spraying automatically the textile in the drum with liquid from a source positioned exterior said drum.

26. In a process according to claim 25, controlling said spraying to be in conjunction with rotation of the drum.

27. In a process according to claim 26, programming said rotating and said controlling to provide reversible rotating of the drum, with a dwell time; and spraying distinctively in each direction of rotating and during dwell time.

28. In a process according to claim 21, the added step of:

spotting the textile while using a spotting board; and coupling to the spotting board vacuum generated by the machine.

29. In a textile cleaning kit for manual use in the cleaning of textile in a home-use clothes dryer having a rotatable drum, said kit including:

highly absorbent pad material to be placed into the drum, whereby, the textile only being dampened by liquid, other than for spotting, prior to the textile being placed into the drum and not being soaked or immersed in any liquid in the drum; and rotation of the drum causes rubbing contact between said pad material and the dampened textile, for transfer of soil and liquid from the textile to said pad material.

30. Apparatus for cleaning textile in a drum ratable within a machine, said drum and machine having means for venting air from within said drum to exterior of said machine; said apparatus comprising:

means for dampening and hydrating the textile, other than for spotting, in the absence of soaking or immersing the textile in any liquid;

means for regulating the venting of air from said drum, to thereby control the extent and duration of the hydration of the textile and;

a spotting board, vacuum coupled to said machine and;

said machine being a home-use clothes dryer.

31. In a process for cleaning textile in a rotatable drum within a machine, the machine having means for venting air from within the drum, said process including the steps of:

dampening the textile with liquid, other than for spotting, in the absence of soaking or immersing the textile in any liquid;

placing highly absorbent pad material into the drum for absorbing at least some of the liquid in the drum for release back into air within the drain at a rate slower than being released from the dampened textile;

regulating the venting of air from the drum, and thereby:

controlling the duration that the textile maintains hydration from the liquid dampening.

32. In the process according to claim 31, the step of dampening being:

manually dampening the textile with liquid, exterior to the drum and machine.

33. In the process according to claim 32, obtaining the liquid from a kit.

34. In the process according to claim 31, obtaining the highly absorbent pad material from a kit.

35. In the process according to claim 34, depositing the dampened textile into a containment bag containing the highly absorbent pad material;

putting the containment bag into the drum;

causing the drum to rotate, whereby the textile and pad material will rub against each other for;

effecting soil and liquid to be transferred from the textile to the pad material.

36. In a process according to claim 31, said step of dampening being attained by;

spraying automatically the liquid into the drum from exterior the drum.

37. In a process according to claim 31, said step of dampening also including:

spraying automatically into the drum from exterior the drum at least one of the liquid, steam, air and water.

38. In a process according to claim 31, placing highly absorbent pad material into the drum; whereby, rotating of the drum causing the dampened textile and pad material to tumble against each other to effect;

rubbing of the soil and liquid off from the textile and onto the pad material.

* * * * *